US008480386B2

(12) United States Patent
Schneider

(10) Patent No.: US 8,480,386 B2
(45) Date of Patent: Jul. 9, 2013

(54) VANE FOR A SINGLE-VANE VACUUM PUMP

(75) Inventor: Willi Schneider, Bodelshausen (DE)

(73) Assignee: Joma-Polytec GmbH, Bodelshausen (DE)

( * ) Notice: Subject to any disclaimer, the term of this patent is extended or adjusted under 35 U.S.C. 154(b) by 260 days.

(21) Appl. No.: 13/126,171

(22) PCT Filed: Jul. 23, 2009

(86) PCT No.: PCT/EP2009/059478

§ 371 (c)(1),
(2), (4) Date: Apr. 27, 2011

(87) PCT Pub. No.: WO2010/052038

PCT Pub. Date: May 14, 2010

(65) Prior Publication Data

US 2011/0206550 A1 Aug. 25, 2011

(30) Foreign Application Priority Data

Nov. 4, 2008 (DE) ..... 10 2008 057 227

(51) Int. Cl.

| | |
|---|---|
| ***F01C 21/10*** | (2006.01) |
| ***F03C 2/00*** | (2006.01) |
| ***F03C 4/00*** | (2006.01) |
| ***F04C 2/00*** | (2006.01) |

(52) U.S. Cl.
USPC ..... 418/178; 418/235; 418/236; 418/259

(58) Field of Classification Search
USPC ..... 418/178–179, 235, 236, 259, 266–268
See application file for complete search history.

(56) References Cited

U.S. PATENT DOCUMENTS

| | | | | | |
|---|---|---|---|---|---|
| RE24,932 | E | * | 1/1961 | Davey | 418/178 |
| 4,518,333 | A | * | 5/1985 | Seki et al. | 418/178 |
| 5,181,844 | A | * | 1/1993 | Bishop et al. | 418/178 |
| 6,227,832 | B1 | * | 5/2001 | Rechberger | 418/150 |

FOREIGN PATENT DOCUMENTS

| | | | |
|---|---|---|---|
| DE | 2600972 A | * | 3/1977 |
| DE | 100 46 697 | | 4/2002 |
| DE | 10 2006 055 158 | | 5/2008 |
| GB | 511 298 | | 8/1939 |
| GB | 795204 | * | 7/1956 |
| GB | 2 394 006 | | 4/2004 |
| JP | 59 165 884 | | 9/1984 |
| JP | 61 046 486 | | 3/1986 |
| JP | 2002227784 | | 8/2002 |
| WO | WO 99/11907 | | 3/1999 |
| WO | WO 2004/074687 | | 9/2004 |

* cited by examiner

*Primary Examiner* — Theresa Trieu
(74) *Attorney, Agent, or Firm* — Paul Vincent

(57) ABSTRACT

The invention relates to a vane for a vane pump, in particular a vane vacuum pump, having a crucible-shaped housing and provided with a rotor mounted eccentrically and rotatably in the housing, wherein the vane is displaceably mounted perpendicular to the axis of rotation in the rotor and the free ends thereof are in contact with the interior circumferential surface of the housing, wherein the vane has a closed surface, at least in the sections protruding beyond the rotor, in the direction of the interior circumferential surface, and the surface is formed by an exterior wall, which is provided with a coating, wherein the coating is provided with perforations in the area located inside the rotor.

11 Claims, 3 Drawing Sheets

VANE FOR A SINGLE-VANE VACUUM PUMP

This application is the national stage of PCT/EP2009/059478 filed on Jul. 23, 2009 and claims Paris Convention Priority of DE 10 2008 057 227.6 filed Nov. 04, 2008.

BACKGROUND OF THE INVENTION

The invention concerns a vane for a pump or a compressor, in particular, for a single-vane vacuum pump having a pot-shaped housing and being provided with a rotor which is eccentrically and rotatably mounted in the housing, wherein the vane is mounted in the rotor in such a fashion that it can be displaced orthogonally with respect to the axis of rotation, and abuts with its free ends against the inner circumferential surface of the housing, wherein the vane has a closed surface, at least in the sections projecting past the rotor, in the direction of the inner circumferential surface, and the surface is formed by an external wall which is provided with a coating.

Single-vane vacuum pumps are well known. DE 100 46 697 A1 discloses e.g. a vane vacuum pump comprising the features of the pre-characterizing part of claim 1. A vane for a pump of this type is also disclosed in WO 2004/074687 A2. One embodiment of the vane disclosed in this document consists of a high-strength thermosetting material which is coated with a wear-resistant thermosetting material. This combines the properties of the two thermosetting materials, thereby producing a high-strength vane which has a wear-resistant surface.

A vane of this type is held in a slot located in the rotor and, upon rotation of the rotor, oscillates within the slot at a relatively high speed. Since the vane must be held in a fluid-tight fashion in the slot, but the play should be sufficiently large to ensure that the friction forces are acceptably small, a compromise must be found between leakage loss between the pressure space and the vacuum space and wear on the vane and the rotor.

The invention is based on the object of providing a vane for a vane pump which has even less wear and can be guided as tightly as possible in the rotor.

SUMMARY OF THE INVENTION

This object is achieved in accordance with the invention with a vane of the above-mentioned type in that the coating in the area inside the rotor has gaps.

The area of the inventive vane, where it is held and guided within the rotor, i.e. in the slot of the rotor, has gaps. These gaps are used to form pockets for storing lubricant or lubricating agents to ensure that the vane does not run dry in the slot. The lubricant is additionally used to seal the vane against the rotor, thereby further improving the efficiency of the pump.

In accordance with the invention, the feature of combining the high-strength vane with a wear-resistant coating is supplemented in that the wear-resistant coating additionally has gaps or pockets in which lubricant can collect such that this lubricant can be distributed over the guiding and sealing area of the vane in a relatively uniform fashion.

In a further development of the invention, the coating is flush with the surface of the base body. This means that the surface of the coating and the surface of the base body are in one plane. This combines the two material properties, i.e. high strength and low wear substantially in one plane.

In an alternative embodiment, the coating is elevated with respect to the surface of the base body. The areas between the coating, i.e. the areas of the surface of the base body which are not coated thereby form depressions in which lubricant can collect. The gaps form, in particular, pockets which are used as storage chambers for lubricant or lubricating agent. The lubricating agent passes from these pockets to the surface to be lubricated and sealed, in particular, to the coating surface that abuts the rotor.

In a further development of the invention, at least sections of the vane are hydrophilic. The surface in the gaps may preferably be hydrophilic such that the lubricant preferably collects in these gaps and the surface of the coating to be wetted is provided or fed with lubricant from these gaps.

In an alternative embodiment, the surface in the gaps is hydrophobic. These hydrophobic areas are advantageous in that the lubricant can be removed again from these areas without any problem and be guided to the areas of the coating to be lubricated, thereby preventing capillary action.

In one particularly preferred embodiment, the coating has a network structure in the area of the gaps. This network structure may be striped, honeycombed or knurled or have any other suitable structure. This structure is advantageous in that the lubricant can easily collect in the formed pockets and is permanently available for lubricating the desired abutment surfaces.

The coating is advantageously sprayed onto the external wall. Other joining or coating methods may, however, also be used, e.g. gluing, baking or using a two-component spraying method, in which the two materials are processed at the same time.

In a further development, the external wall has depressions that completely or partially receive the coating. The depressions in the external wall are advantageous in that the coating is optimally anchored in or on the external wall of the vane and for this reason, materials can be combined with each other which are difficult to merge.

The gaps are advantageously designed in the form of strips. These strips extend transversely with respect to the direction of movement of the vane, i.e. parallel to the axis of rotation of the rotor. The coating thereby forms one or more strips which are offset from each other to thereby form the strip-shaped gaps between these strips. Since the strips extend across the entire width of the vane, it is ensured that the surface of the vane is provided with lubricant across its entire width.

The strips of the coating and the strip-shaped gaps may thereby have the same or a different width. The width of the coating is selected in such a fashion that the required bearing surface is provided for and also that the width and the depth of the gaps are adjusted to the required amount of lubricant to be stored.

Further advantages, features and details of the invention can be extracted from the dependent claims and the following description which describes in detail three particularly preferred embodiments with reference to the drawing. The features shown in the drawing and mentioned in the claims and the description may be essential for the invention either individually or collectively in arbitrary combination.

In the drawing:

DESCRIPTION OF THE PREFERRED EMBODIMENT

Figure 1:
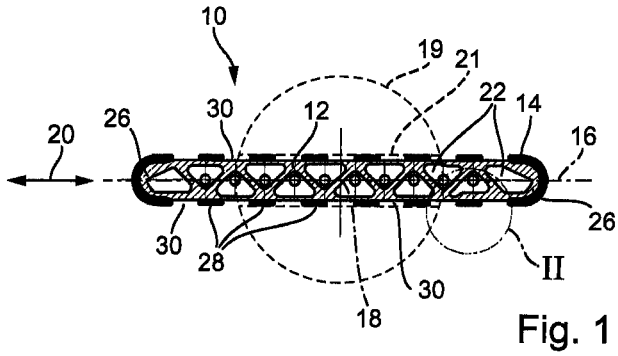
FIG. 1 shows a cross-section along the longitudinal axis of a first embodiment of a vane.

FIG. 1 shows a vane designated in total with reference numeral 10, which consists of a base body 12 and a coating 14. The base body 12 is formed e.g. from a high-strength thermosetting material, wherein the coating is a wear-resistant thermosetting material. Other materials and material combinations are clearly also feasible. The longitudinal axis 16 extends along the longitudinal extension of the vane 10, transversely to the axis of rotation 18 of a rotor 19 that is only schematically indicated. The vane 18 oscillates within a slot 21 of this rotor 19 in the direction of the longitudinal axis 16, i.e. in the direction of the double arrow 20. The vane 10 and, in particular the base body 12, also have cavities 22 which penetrate through the vane 10 parallel to the axis of rotation 18 and reduce its weight.

Figure 2:
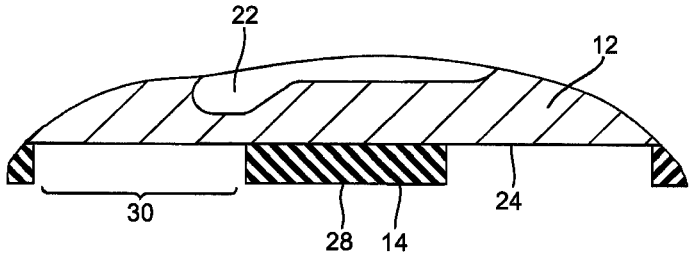
FIG. 2 shows an enlarged view of the section II in accordance with FIG. 1.

As is illustrated in FIG. 2, the coating 14 is applied, in particular sprayed, onto the surface 24 of the base body 12. The coating 14 is therefore elevated with respect to the surface 24 of the base body 12. One can also see that the coating 14 extends past the two ends 26 of the base body 12 and is designed in the form of strips between these two ends 26. These strips 28 extend parallel with respect to the axis of rotation 18. Gaps 30 are provided between these two strips 28, wherein these gaps 30 are also designed in the form of strips 32. The surface 24 of the base body 12 is freely accessible in these gaps 30, wherein the surface 24 may be hydrophobic or hydrophilic.

Figure 3:
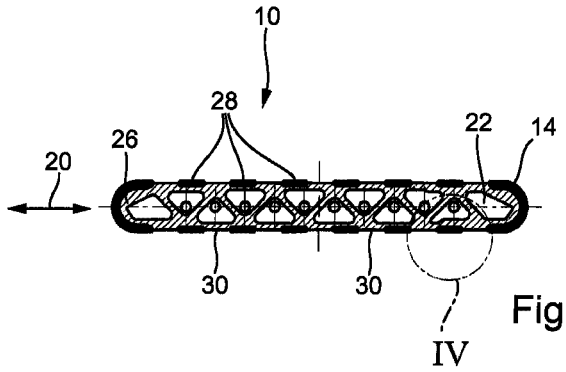
FIG. 3 shows a cross-section along the longitudinal axis of a second embodiment of the vane.
Figure 4:
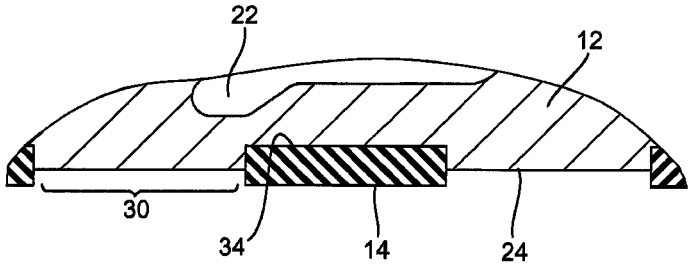
FIG. 4 shows an enlarged view of the section IV in accordance with FIG. 3.

FIGS. 3 and 4 show a second embodiment of the vane 10, wherein the surface 24 of the base body 12 has depressions 34 into which the coating 14 is partially injected. The depth of these depressions 34 is selected in such a fashion that the coating 14 still projects past the surface 24 of the base body 12, wherein the gaps 30 then have a lower depth compared to the embodiment of FIGS. 1 and 2.

Figure 5:
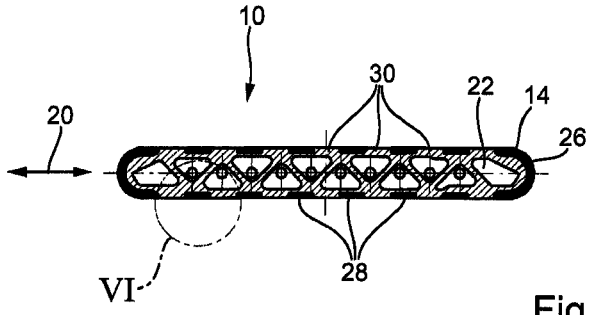
FIG. 5 shows a cross-section along the longitudinal axis of a third embodiment of the vane.
Figure 6:
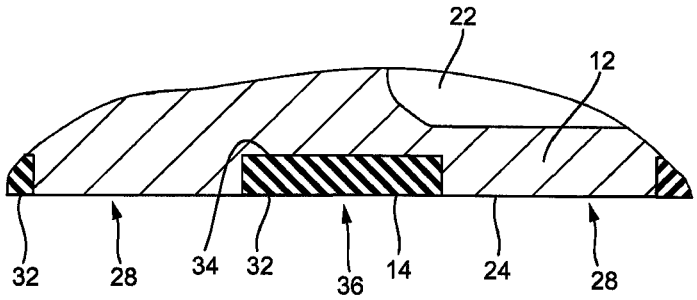
FIG. 6 shows an enlarged view of the section VI in accordance with FIG. 5.

FIGS. 5 and 6 show a third embodiment of the vane 10, wherein, in this case, the depressions 34 are selected in such a fashion that they completely receive the coating 14. This means that the external side of the coating 14, which forms a sliding surface 36, lies in the same plane as the surface 24 of the base body 12. In this embodiment, the areas of the surface 24, which form the strips 28 and extend between the strips 32 of the coating 14, are hydrophobic such that the lubricant preferably collects on the sliding surface 36 of the coating 14.

I claim:

1. A vane for a vane pump or for a single-vane vacuum pump, the pump having a pot-shaped housing and a rotor which is eccentrically and rotatably mounted in the housing, the vane being mounted in the rotor in such a fashion that it can be displaced orthogonally with respect to an axis of rotation of the rotor, wherein free ends of the vane abut an inner circumferential surface of the housing, the vane comprising:

a base body having a surface that is closed, at least in sections that project past the rotor; and a coating disposed on said surface of said base body, said coating having gaps in an area located within the rotor, wherein said coating has a network structure in an area of said gaps.

2. The vane of claim 1, wherein said coating is flush or is elevated with respect to said surface of said base body.

3. The vane of claim 1, wherein said gaps define pockets.

4. The vane of claim 1, wherein said surface in said gaps is hydrophobic or hydrophilic.

5. The vane of claim 1, wherein said coating is sprayed onto said surface.

6. The vane of claim 1, wherein said surface has depressions that completely or partially receive said coating.

7. The vane of claim 1, wherein said gaps are designed in the form of first strips.

8. The vane of claim 7, wherein said coating has one or more spaced apart second strips that are offset from each other.

9. The vane of claim 8, wherein said first and second strips extend parallel to the axis of rotation of the rotor.

10. The vane of claim 8, wherein said first and second strips have a same respective width.

11. The vane of claim 8, wherein said first strips of said gaps have a larger width than said second strips of said coating.

* * * * *